US010343446B2

(12) United States Patent
Wakayama et al.

(10) Patent No.: US 10,343,446 B2
(45) Date of Patent: Jul. 9, 2019

(54) WRITING INSTRUMENT

(71) Applicant: KOTOBUKI & CO., LTD., Kawagoe-shi (JP)

(72) Inventors: Takeshi Wakayama, Kawagoe (JP); Yoshio Noguchi, Kawagoe (JP); Hidehei Kageyama, Kawagoe (JP)

(73) Assignee: KOTOBUKI & CO., LTD., Kawagoe-Shi, Saitama (JP)

( * ) Notice: Subject to any disclaimer, the term of this patent is extended or adjusted under 35 U.S.C. 154(b) by 0 days.

(21) Appl. No.: 15/974,059

(22) Filed: May 8, 2018

(65) Prior Publication Data

US 2018/0250977 A1 Sep. 6, 2018

Related U.S. Application Data

(63) Continuation of application No. PCT/JP2016/075461, filed on Aug. 31, 2016.

(30) Foreign Application Priority Data

Nov. 16, 2015 (JP) ..... 2015-223803

(51) Int. Cl.
*B43K 21/16* (2006.01)
*B43K 21/22* (2006.01)

(52) U.S. Cl.
CPC ..... *B43K 21/16* (2013.01); *B43K 21/22* (2013.01)

(58) Field of Classification Search
CPC ..... B43K 21/16; B43K 21/22; B43K 21/18; B43K 21/20; B43K 21/00; B43K 21/02; B43K 21/027
See application file for complete search history.

(56) References Cited

U.S. PATENT DOCUMENTS 4,358,210 A * 11/1982 Hashimoto ..... B43K 21/20 401/62
6,705,789 B2 * 3/2004 Maruyama ..... B43K 21/027 401/67
2007/0025800 A1 2/2007 Burry et al.

FOREIGN PATENT DOCUMENTS

JP S 59-171579 U 12/1980
JP S 59-53987 U 4/1984
JP 2007-307798 A 11/2007

OTHER PUBLICATIONS

International Search Report (ISR) (PCT Form PCT/ISA/210), in PCT/JP2016/075461, dated Nov. 29, 2016.

(Continued)

*Primary Examiner* — David J Walczak
(74) *Attorney, Agent, or Firm* — McGinn IP Law Group, PLLC.

(57) ABSTRACT

A writing instrument according to an embodiment of the invention including, a chuck that chucks a writing lead, wherein the chuck includes a first chuck pawl which comes into point contact or line contact with the writing lead to press the writing lead so as to apply first contact stress to the writing lead; and a second chuck pawl which presses the writing lead so as to apply, to the writing lead, second contact stress that is lower than the first contact stress, and the first contact stress is configured such that, when a prescribed impact is applied to the writing lead, a contact portion of the writing lead subjected to the first contact stress fractures and absorbs the prescribed impact.

14 Claims, 10 Drawing Sheets

(56) References Cited

OTHER PUBLICATIONS

Japanese Notification of Reasons for Refusal dated May 16, 2019 for Japanese Patent Application No. 2015-223803, with an English translation.

* cited by examiner

WRITING INSTRUMENT

CROSS-REFERENCE TO RELATED APPLICATION

This application is based upon and claims the benefit of priority under 35 USC 119 of Japanese Patent Application No. PCT/JP2016/75461 filed on Aug. 31, 2016, the entire disclosure of which, including the description, claims, drawings, and abstract, is incorporated herein by reference in its entirety.

TECHNICAL FIELD

The present invention relates to a writing instrument including a chuck for chucking a writing lead for a writing instrument.

BACKGROUND ART

Conventionally, writing instruments used at construction sites or the like of electrical construction, building construction, and the like are known (for example, refer to Japanese Patent Application Laid-open No. 2007-307798). In a writing instrument disclosed in Japanese Patent Application Laid-open No. 2007-307798, an elastic cylinder body is arranged in a tip part of a tip pipe extending forward from an outer cylinder. The elastic cylinder body is in elastic contact with a writing lead for a writing instrument fed out from a tip of the tip pipe.

According to such a writing instrument, even when some kind of impact acts on the tip pipe in a state where, for example, the tip pipe is inserted into a small groove or the like cut into wood that is a writing object, the impact is absorbed by the elastic cylinder body. Therefore, occurrences of a failure such as breakage of the writing lead for a writing instrument are suppressed.

However, even with the writing instrument including the elastic cylinder body disclosed in Japanese Patent Application Laid-open No. 2007-307798, impact applied to the writing instrument from the outside cannot be completely absorbed by the elastic cylinder body. For this reason, conventionally, there is a need for a writing instrument capable of reducing impact transmitted to a writing lead for a writing instrument from the outside.

SUMMARY OF INVENTION

The present invention provides a writing instrument capable of reducing impact transmitted to a writing lead for a writing instrument from the outside.

In an aspect of a writing instrument according to the present invention, the writing instrument includes; a chuck configured to sandwich and to chuck a writing lead for a writing instrument, wherein the chuck includes; a first chuck pawl which comes into point contact or line contact with the writing lead for a writing instrument to press the writing lead for a writing instrument so as to apply first contact stress to the writing lead for a writing instrument; and a second chuck pawl which presses the writing lead for a writing instrument so as to apply, to the writing lead for a writing instrument, second contact stress that is lower than the first contact stress, and the first contact stress applied by the first chuck pawl to the writing lead for a writing instrument is configured such that, when a prescribed impact is applied to the writing lead for a writing instrument, a contact portion of the writing lead for a writing instrument subjected to the first contact stress fractures and absorbs the prescribed impact.

According to the present invention, a writing instrument capable of reducing impact transmitted to a writing lead for a writing instrument from the outside can be provided.

DESCRIPTION OF EMBODIMENTS

Figure 1:
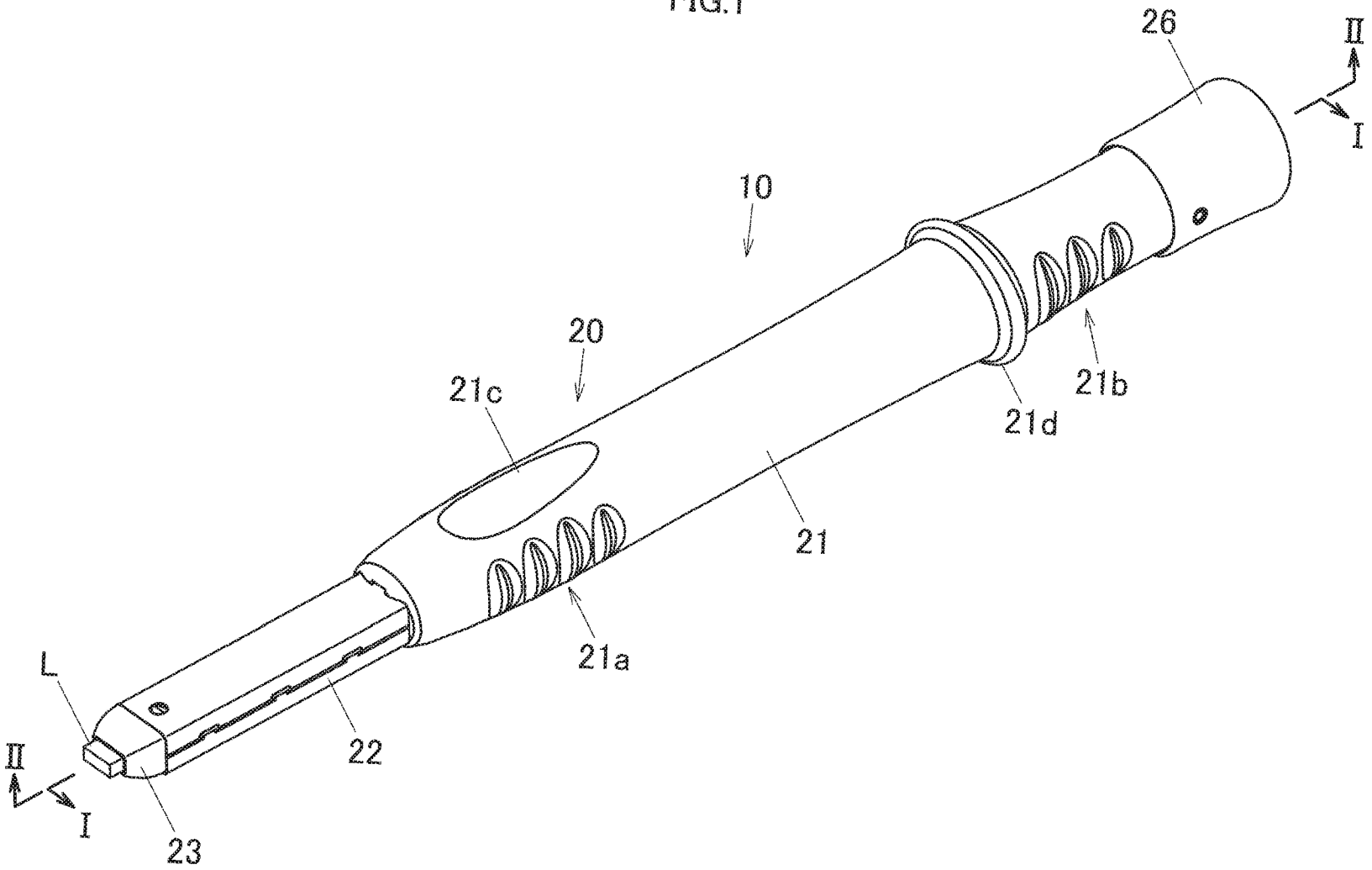
FIG. 1 is a perspective view of a mechanical pencil according to an embodiment of the present invention.

Hereinafter, embodiments of the present invention will be described with reference to the drawings. FIG. 1 is a perspective view illustrating an exterior of a mechanical pencil 10 as an embodiment exemplifying a writing instrument according to the present invention. The mechanical pencil 10 is configured so as to be capable of feeding out (paying out), from a tip thereof, a writing lead for a mechanical pencil L formed by sintering a raw material such as graphite. The writing lead for a mechanical pencil L is formed so as to have a rectangular sectional shape instead of a typically-used circular sectional shape. In this case, since four ridge lines suitable for writing are formed on an outer periphery of the writing lead for a mechanical pencil L, the mechanical pencil 10 can be favorably used for purposes of writing a scribing line in a groove cut into wood and the like at a construction site and the like. Moreover, in the following description, a direction in which the writing lead for a mechanical pencil L is fed out will be referred to as front and an opposite direction thereof will be referred to as rear. In addition, when viewing the rectangular sectional shape of the writing lead for a mechanical pencil L from the rear, a direction in which a central axis in a longitudinal direction of the rectangular sectional shape extends will be referred to as a left-right (horizontal) direction and a direction in which a central axis in a transverse direction of the rectangular sectional shape extends will be referred to as a up-down (vertical) direction.

An operation for feeding out the writing lead for a mechanical pencil L can be performed by a push operation of a push button 26 arranged at a rear end of a barrel 20. The barrel 20 includes a barrel main body 21 formed so as to have an external shape with an approximately elliptical sectional shape of which a major axis direction is consistent with the longitudinal direction of the rectangular sectional shape of the writing lead for a mechanical pencil L. In this manner, a grip part of the writing instrument is favorably formed so that a longitudinal direction of a sectional shape of the grip part is consistent with a longitudinal direction of a sectional shape of the writing lead for a writing instrument. With sectional shapes of a grip part of a writing instrument and a writing lead for a writing instrument, when the sectional shapes respectively have a longitudinal direction and a transverse direction, for example, once a user recognizes by visual confirmation that the longitudinal directions of both sectional shapes are consistent with each other, the user can recognize the longitudinal direction of the sectional shape of the writing lead for a writing instrument by tactile perception when gripping the grip part of the writing instrument without having to visually confirm the longitudinal direction of the sectional shape of the writing lead for a writing instrument. According to this configuration, when gripping the grip part of the writing instrument, the user can sense the longitudinal direction of the sectional shape of the writing lead for a writing instrument by tactile perception. A front barrel 22 is arranged so as to protrude from a front end part of the barrel main body 21. In addition, a tip fitting 23 (to be described in detail later) formed so as to taper off toward a tip side is arranged in a tip part of the front barrel 22. The writing lead for a mechanical pencil L is fed out from a tip opening of the tip fitting 23 so as to penetrate the front barrel 22 and the tip fitting 23.

Slip resistant parts 21*a* and 21*b* formed so as to include irregularities are arranged on both left and right side surfaces of front and rear end parts on an outer surface of the barrel main body 21. Moreover, as illustrated, arranging the slip resistant parts 21*a* and 21*b* only in the longitudinal direction of the sectional shape of the writing lead for a mechanical pencil L enables the user to better sense the longitudinal direction of the sectional shape of the writing lead for a mechanical pencil L by tactile perception. In addition, a flat part 21*c* which a shape that differs in tactile sensation from the slip resistant parts 21*a* and 21*b* in the longitudinal direction is formed at a position on an outer surface of the barrel main body 21 in the transverse direction of the sectional shape of the writing lead for a mechanical pencil L. In this manner, according to a configuration in which irregularities with different shapes are formed on the grip part of the writing instrument so as to correspond to the longitudinal direction and the transverse direction of the sectional shape of the writing lead for a writing instrument, the user can more readily sense the sectional shape of the writing lead for a writing instrument by tactile perception.

An annular flange part 21*d* capable of more reliably preventing the writing instrument from sliding in a front-rear direction is formed on the barrel main body 21 in a vicinity of the rear end-side slip resistant part 21*b*. In addition, the front end-side slip resistant part 21*a* and the rear end-side slip resistant part 21*b* are formed so as to respectively include a different number of irregularities. In this manner, according to a configuration in which irregularities formed on the grip part of the writing instrument are arranged in different numbers in the front-rear direction of the writing instrument, the user can readily sense the front-rear direction of the writing instrument by tactile perception.

Figure 2:
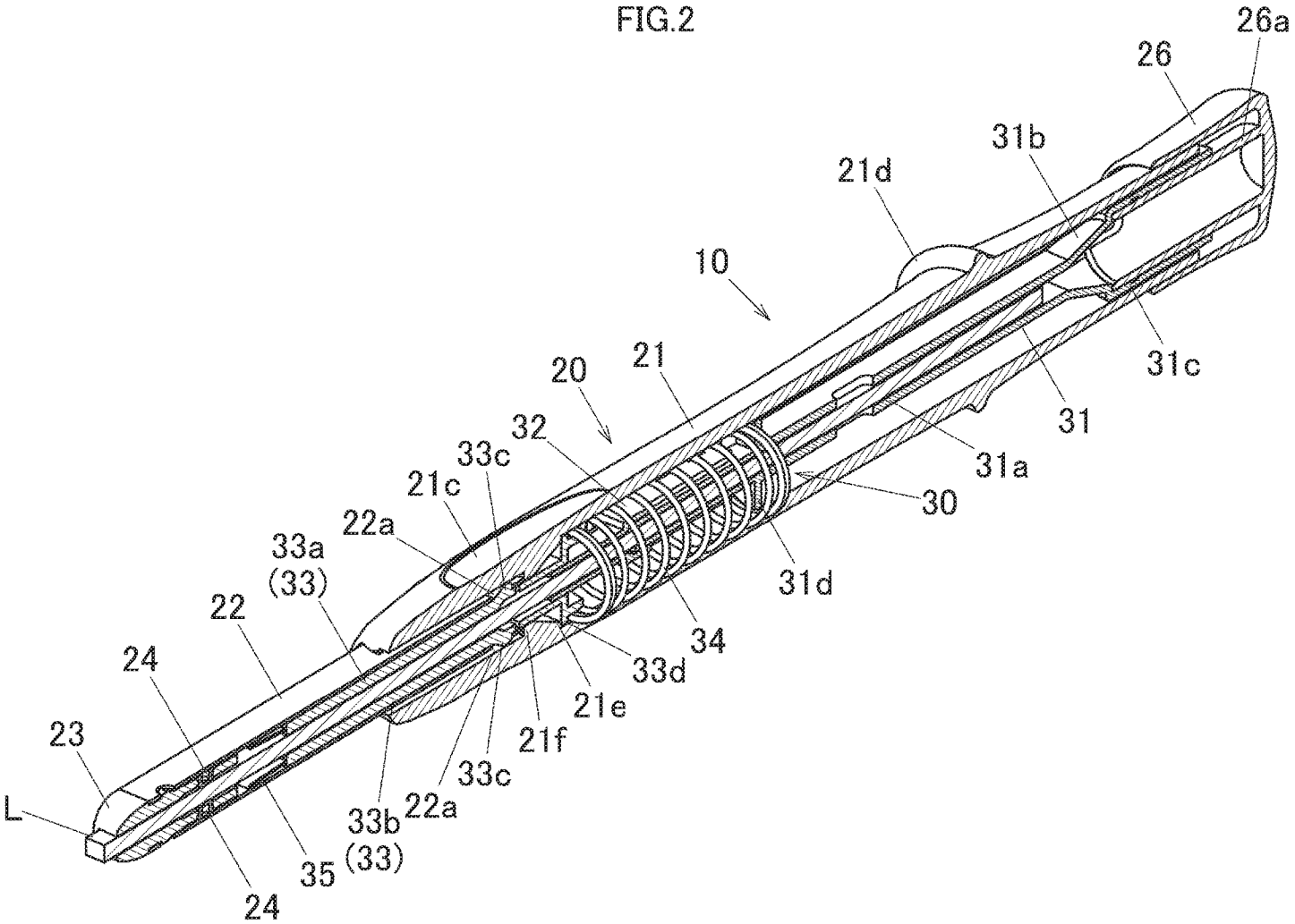
FIG. 2 is a sectional view illustrating a mechanical pencil according to an embodiment of the present invention by excluding a part of the mechanical pencil and cutting the mechanical pencil along a cutting plane having a normal I illustrated in FIG. 1 on a central axis of the mechanical pencil.
Figure 3:
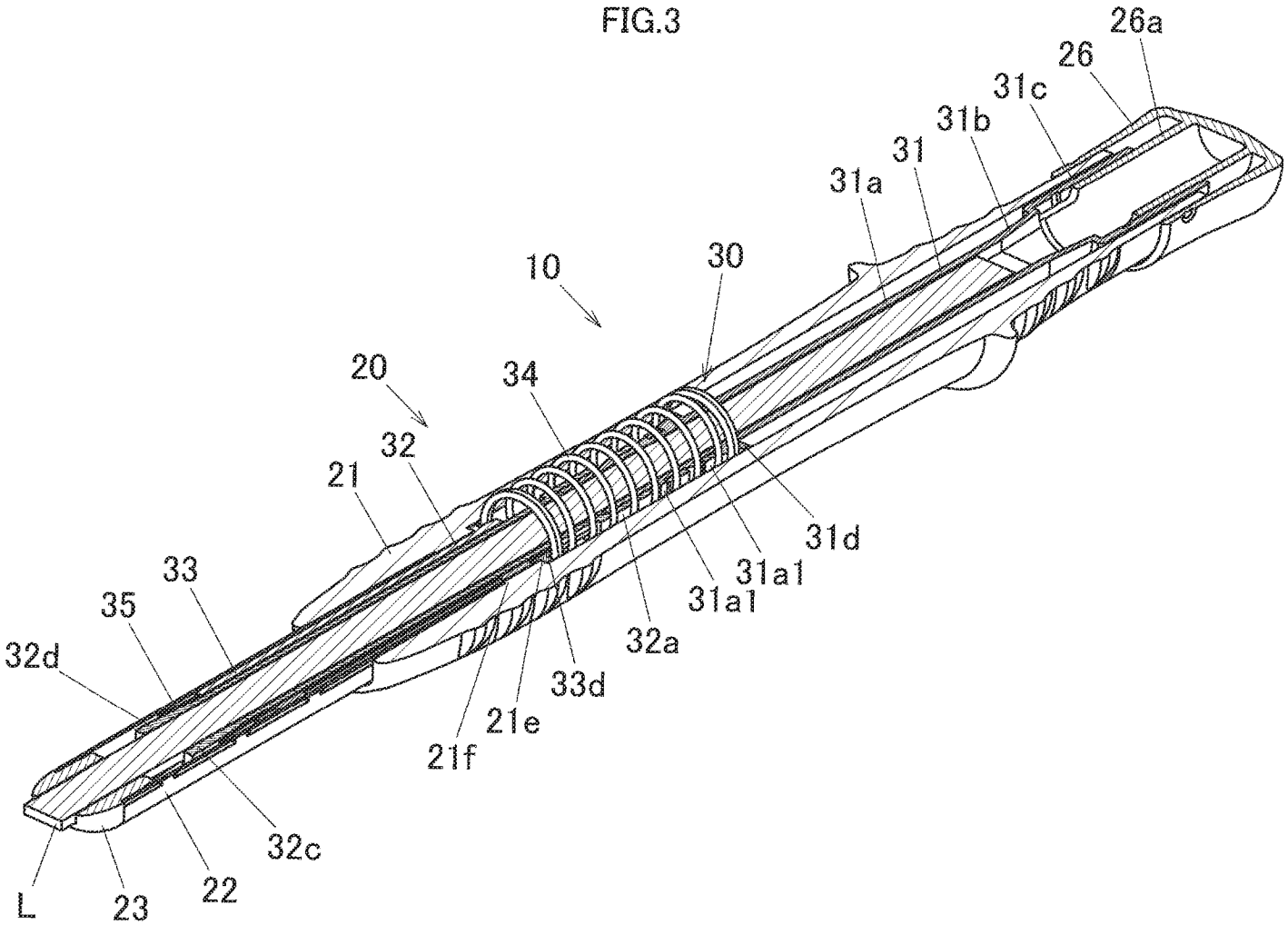
FIG. 3 is a sectional view illustrating a mechanical pencil according to an embodiment of the present invention by excluding a part of the mechanical pencil and cutting the mechanical pencil along a cutting plane having a normal II illustrated in FIG. 1 on a central axis of the mechanical pencil.
Figure 4:
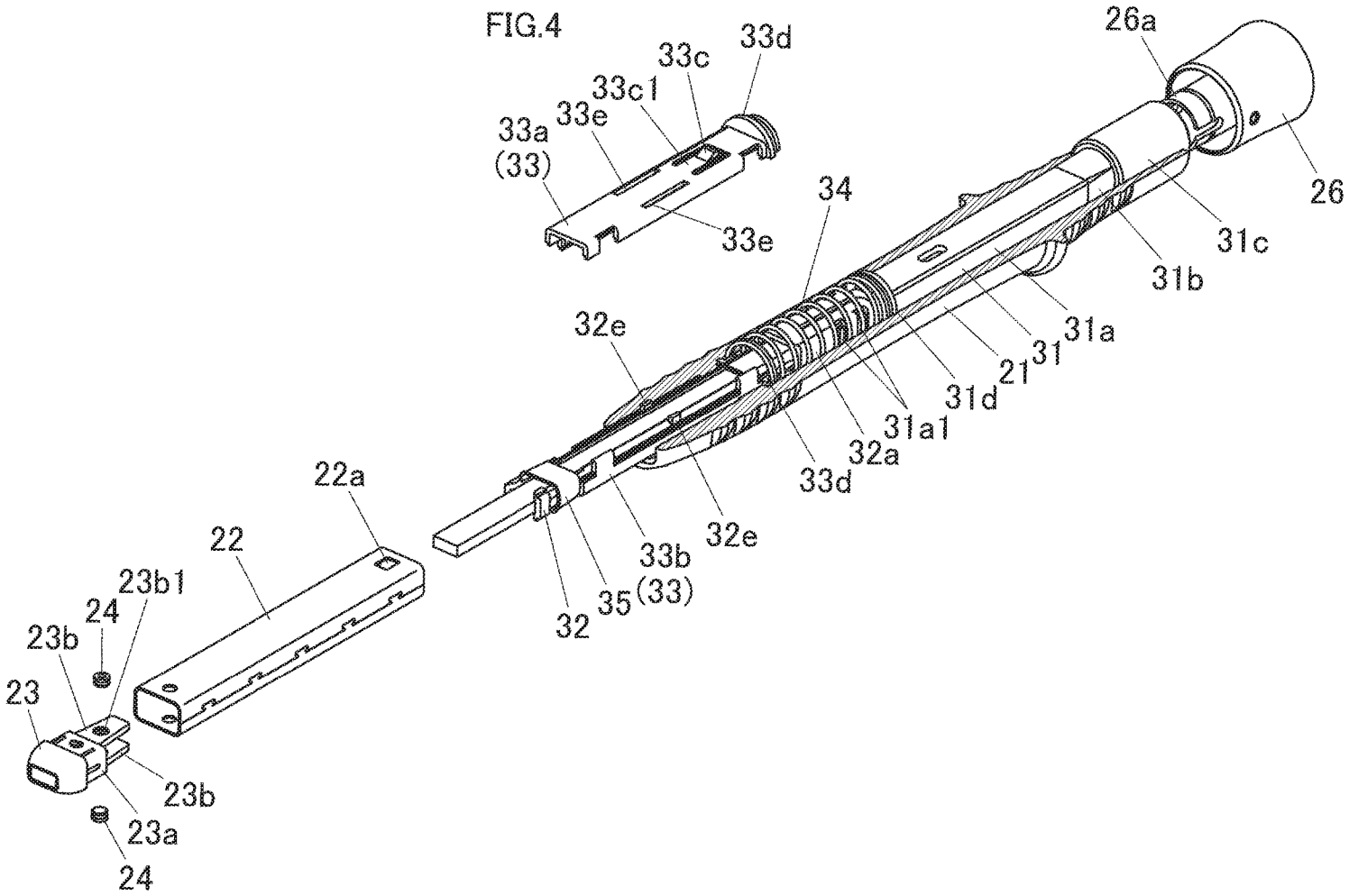
FIG. 4 is an exploded perspective view illustrating an exploded mechanical pencil according to an embodiment of the present invention. In the diagram, a part of the mechanical pencil is illustrated cut along a cutting plane having the normal II illustrated in FIG. 1 on a central axis of the mechanical pencil.

A feed-out mechanism 30 included in the mechanical pencil 10 will now be described with reference to FIGS. 2 to 4. The feed-out mechanism 30 is configured to chuck (grip) the writing lead for a mechanical pencil L housed in the mechanical pencil 10 and to feed out the writing lead for a mechanical pencil L forward. The feed-out mechanism 30 includes a lead tank 31 that houses the writing lead for a mechanical pencil L, a chuck 32 that chucks the writing lead for a mechanical pencil L, an inner shaft 33 that guides sliding of the chuck 32 in the front-rear direction, a spring 34 that biases an assembly constituted by the chuck 32 and the lead tank 31 rearward, and a chuck ring 35 that presses the chuck 32 against the writing lead for a mechanical pencil L from an outer periphery.

The lead tank 31 will be described. A forward side of the lead tank 31 is formed as a square tube part 31*a* having inside thereof a square hole with a size capable of housing the sectional shape of the writing lead for a mechanical pencil L with a prescribed clearance. According to this configuration, the writing lead for a mechanical pencil L can be housed in the square tube part 31*a* of the lead tank 31 in a state where the longitudinal direction of the sectional shape of the writing lead for a mechanical pencil L is aligned with a clamping direction of the chuck 32 to be described in detail later. A rearward side of the lead tank 31 is formed as an introducing part 31*b* for introducing the writing lead for a mechanical pencil L to the square tube part 31*a* and a cylindrical part 31*c* having a circular rear end opening. The push button 26 formed in a double cylinder shape including an inner cylinder 26*a* blocks the rear end opening of the cylindrical part 31*c*. The inner cylinder 26*a* of the push button 26 is press-fitted into the rear end opening of the cylindrical part 31*c* with a fitting force that allows the inner cylinder to be detachable. An outer cylinder of the push button 26 is positioned on an outer side of the barrel main body 21 and covers a part of an outer periphery of the barrel. A spring pressing part 31*d* that abuts against a rear end of the spring 34 to be described in detail later is formed on an outer periphery of the lead tank 31.

Figure 5:
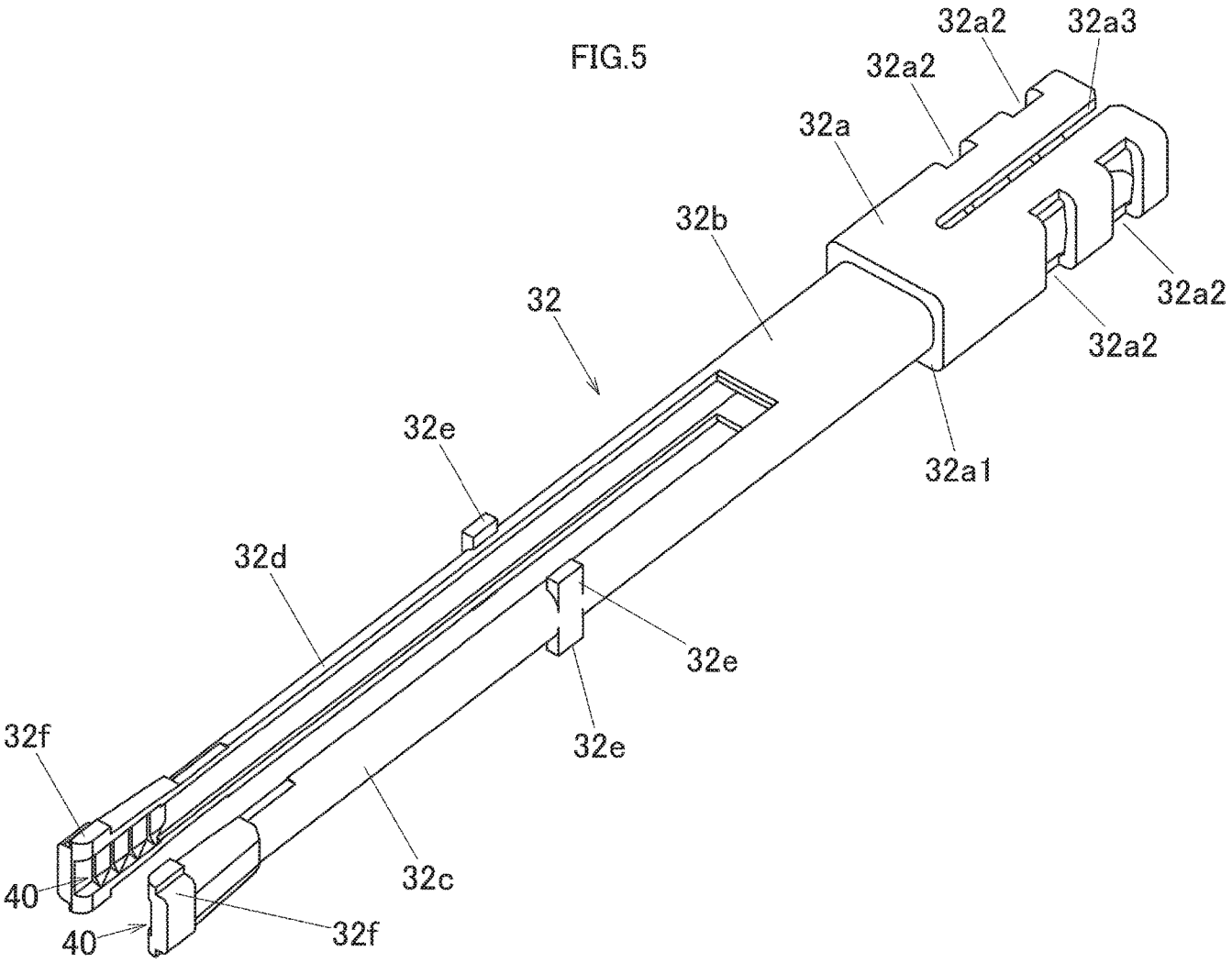
FIG. 5 is a perspective view of a chuck of a mechanical pencil according to an embodiment of the present invention.

The chuck 32 will be described with reference to FIG. 5. A connecting part 32*a* with an approximately square tube shape is formed on a rearward side of the chuck 32. As will be described in detail later, the connecting part 32*a* is connected to a tip portion of the lead tank 31. A base end part 32*b* with an approximately square tube shape of which an external shape in a transverse section is smaller than the connecting part 32*a* is formed to the front of the connecting part 32*a*. A left chuck piece 32*c* and a right chuck piece 32*d* formed in a bifurcated shape extending forward from the base end part 32*b*. The left chuck piece 32*c* and the right chuck piece 32*d* oppose each other in the clamping direction (a direction toward a central axis extending in the front-rear direction of the writing instrument from left or right) of the chuck 32.

Two locking holes 32*a*2 are formed on each of two side surfaces of the connecting part 32*a*. A locking projection 31*a*1, of which two are formed on each of two side surfaces of a tip part of the square tube part 31*a* of the lead tank 31, is locked by the locking hole 32*a*2 (refer to FIGS. 8 to 10). Accordingly, the chuck 32 is connected and locked to the lead tank 31. A slit 32*a*3 is formed on upper and lower surfaces of the connecting part 32*a*. By forming the slit 32*a*3, when the square tube part 31*a* of the lead tank 31 is inserted into the connecting part 32*a* of the chuck 32, the square tube part 31*a* can be inserted more readily since the connecting part 32*a* becomes more readily openable in a lateral direction.

The chuck 32 is formed of a resin having elasticity. In addition, in a free state where external forces do not act on the chuck 32, the chuck 32 is formed in a shape that is resiliently restored by its elasticity up to a release position where the left and right chuck pieces 32*c* and 32*d* open outward (the horizontal direction) on an opposite side to the clamping direction of the chuck 32 to release the writing lead for a mechanical pencil L. A plurality of (in the present embodiment, four) chuck pawls 40 are respectively formed arranged in the front-rear direction on inner surfaces of the left and right chuck pieces 32*c* and 32*d*. Each chuck pawl 40 is formed in an approximately wedge shape that protrudes approximately perpendicular to the inner surfaces of the left and right chuck pieces 32*c* and 32*d*. As will be described in detail later, the chuck 32 moves rearward due to an action of the spring 34 and fits into the chuck ring 35 (refer to FIG. 8). At this point, the writing lead for a mechanical pencil L is chucked (gripped) by the plurality of chuck pawls 40 arranged so as to oppose each other in the clamping direction of the chuck 32.

The chuck pawls 40 chuck the writing lead for a mechanical pencil L in a tip part of the mechanical pencil 10. In this manner, according to a configuration in which the writing lead for a writing instrument is chucked in a tip part of the writing instrument, a moment arm from a tip of the writing lead for a writing instrument to a chuck position of the writing lead for a writing instrument can be reduced to prevent breakage (bending fracture) of the writing lead for a writing instrument due to an external force that is applied to the tip of the writing lead for a writing instrument. A length of the moment arm from the tip of the writing lead for a writing instrument to the chuck position of the writing lead for a writing instrument may be favorably set to a length that is 60% or less, more favorably set to a length that is 40% or less, and most favorably set to a length that is 20% or less of an entire length of an unused writing lead for a writing instrument.

Figure 6:
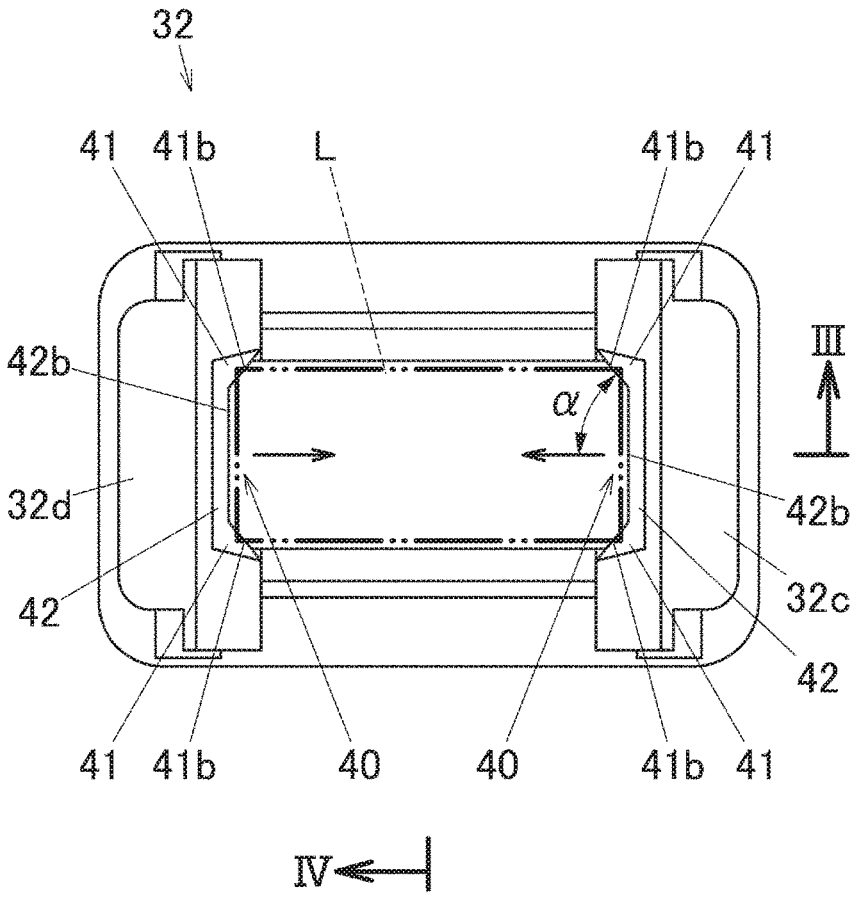
FIG. 6 is a diagram illustrating a chuck of a mechanical pencil according to an embodiment of the present invention as viewed from the front of the chuck.

A shape of the chuck pawl 40 will be described with reference to FIG. 6. FIG. 6 is a diagram of the chuck 32 as viewed from a tip side, illustrating a state where the chuck 32 is actuated in the clamping direction and the writing lead for a mechanical pencil L is sandwiched and chucked by the chuck pawls 40. Each chuck pawl 40 of the left and right chuck pieces 32*c* and 32*d* include a first chuck pawl 41 and a second chuck pawl 42. As illustrated, a plurality of first chuck pawls 41 (in the present embodiment, two for each chuck pawl 40) are arranged separated from each other in the vertical direction. The second chuck pawl 42 is arranged between the first chuck pawls 41. Chucking of the writing lead for a mechanical pencil L by the chuck pawls 40 will be described in detail later.

Figure 7:
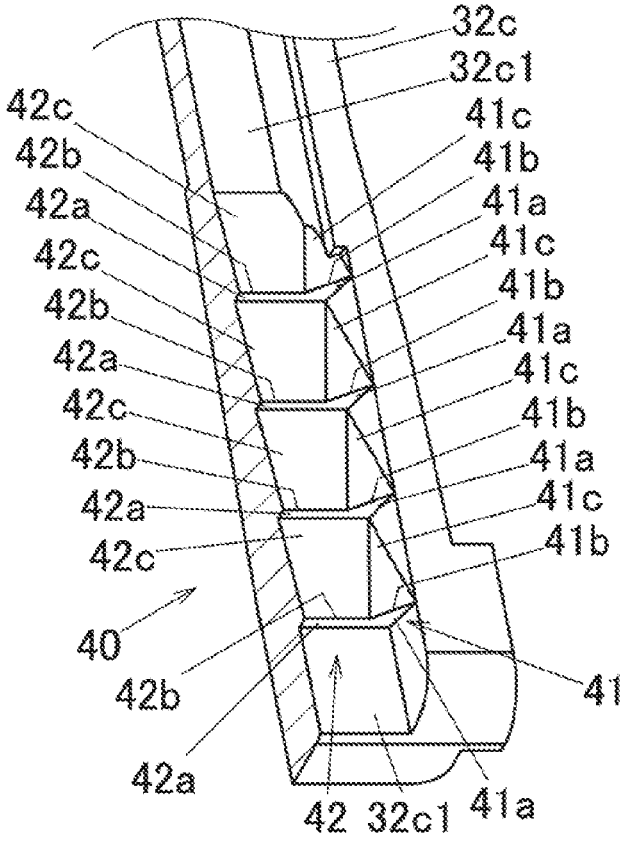
FIG. 7 is a partial sectional perspective view illustrating a tip portion of a chuck of a mechanical pencil according to an embodiment of the present invention by cutting the tip portion along a cutting plane having a normal III and a cutting plane having a normal IV illustrated in FIG. 6.

The shape of the chuck pawl 40 will be further described with reference to FIG. 7. FIG. 7 is a perspective view illustrating a portion on an inner side (a right side) of the left chuck piece 32*c* as viewed from the front and obliquely upper right of the portion. To facilitate understanding, the diagram illustrates a state where an upper half of the left chuck piece 32*c* has been cut away. The first chuck pawl 41 includes a first wall surface 41*a*, a first inclined surface 41*c*, and a first tip edge (a ridge line of a tip) 41*b* formed therebetween. The first wall surface 41*a* is formed perpendicular to an inner surface 32*c*1 of the left chuck piece 32*c*. In addition, the first tip side 41*b* is formed as a ridge line that is inclined relative to the clamping direction of the chuck 32. Therefore, as will be described in detail later, when the first tip edge 41*b* is pressed onto and comes into contact with a ridge line extending in the longitudinal direction (the front-rear direction) of the writing lead for a mechanical pencil L, the first tip edge 41*b* can substantially come into point contact with the writing lead for a mechanical pencil L (refer to FIG. 6). The first inclined surface 41*c* is formed inclined so as to form an acute angle with the first wall surface 41*a*. In other words, a tip of the first chuck pawl 41 is formed in a wedge shape having an acute angle. Therefore, as will be described in detail later, even after a point contact portion of the writing lead for a mechanical pencil L with the first chuck pawl 41 partially fractures, the first chuck pawl 41 and the writing lead for a mechanical pencil L can substantially come into line contact with each other.

The second chuck pawl 42 includes a second wall surface 42*a*, a second inclined surface 42*c*, and a second tip edge (a ridge line of a tip) 42*b* formed therebetween. The second wall surface 42*a* is formed perpendicular to the inner surface 32*c*1 of the left chuck piece 32*c*. The second inclined surface 42*c* is formed inclined so as to form an acute angle with the second wall surface 42*a*. In other words, a tip of the second chuck pawl 42 is formed in a wedge shape having an acute angle. Therefore, as will be described in detail later, even after a line contact portion of the writing lead for a mechanical pencil L with the second chuck pawl 42 partially fractures, the second chuck pawl 42 and the writing lead for a mechanical pencil L can substantially come into line contact with each other.

Let us now return to FIG. 5 to further describe the chuck 32. A sliding projection 32*e* that protrudes in the vertical direction of the chuck 32 is respectively formed at an approximately central position in the front-rear direction of the left and right chuck pieces 32*c* and 32*d*. The sliding projection 32*e* engages with a sliding groove 33*e* (refer to FIG. 4) of the inner shaft 33 to be described in detail later and guides sliding of the chuck 32 in the front-rear direction.

A bulging part 32*f* is formed in respective tip parts of the left and right chuck pieces 32*c* and 32*d*. As will be described in detail later, a front end surface of the chuck ring 35 abuts against the bulging part 32*f* when fitted to the chuck 32 (refer to FIG. 8).

Let us now return to FIG. 4 to further describe the feed-out mechanism 30 of the writing lead for a mechanical pencil L. The inner shaft 33 is arranged on outer peripheries of the left and right chuck pieces 32*c* and 32*d* inside the barrel 20. The inner shaft 33 is constituted by two components, namely, a first inner shaft component 33*a* on an upper half side and a second inner shaft component 33*b* on a lower half side. By forming the inner shaft 33 as an assembly of the first inner shaft component 33*a* and the second inner shaft component 33*b* which are split-halves of the inner shaft 33 sharing a same shape, the inner shaft 33 with a complicated shape can be readily manufactured by injection molding of a resin material.

The inner shaft 33 has a locking projection 33*c* in a free end part of an elastic piece 33*c*1 formed on upper and lower surfaces of the inner shaft 33. Locking holes 22*a* are respectively formed on upper and lower surfaces of the front barrel 22 so as to correspond to the locking projection 33*c*. The inner shaft 33 and the front barrel 22 are engaged with each other due to an engagement of the locking projection 33*c* of the inner shaft 33 with the locking holes 22*a* of the front barrel 22.

Two sliding grooves 33*e* extending in the front-rear direction are respectively formed on the upper and lower surfaces of the inner shaft 33. The sliding projection 32*e* of the chuck 32 is inserted into the sliding grooves 33*e* in a state where the sliding projection 32*e* is slidable in the front-rear direction. Movement of the chuck 32 in the front-rear direction is guided due to sliding of the sliding projection 32*e* and the sliding grooves 33*e*.

A flange-shaped spring pressing part 33*d* is formed at a rear end of the inner shaft 33. A front surface of the spring pressing part 33*d* of the inner shaft 33 abuts against a step part 21*e* formed on an inner surface of the barrel main body 21 from the rear (refer to FIG. 2). In addition, a rear end of the front barrel 22 engaged with the inner shaft 33 abuts, from the front, against a step part 21*f* of the barrel main body 21 formed to the front of the step part 21*e* (refer to FIG. 2). With the step parts 21*e* and 21*f* of the barrel main body 21 in between, by having the inner shaft 33 to the rear engage with the front barrel 22 to the front, the feed-out mechanism 30 is positioned and fixed in the front-rear direction with respect to the barrel 20 (refer to FIG. 2).

The assembly of the chuck 32 and the lead tank 31 is arranged in the inner shaft 33 so as to be slidable in the front-rear direction in a state of being biased rearward by the spring 34. The spring 34 biases the assembly of the chuck 32 and the lead tank 31 rearward in a state where the spring 34 is compressed between the spring pressing part 31*d* of the lead tank 31 and the spring pressing part 33*d* of the inner shaft 33.

The chuck ring 35 is fitted to the outer periphery of the chuck 32 from the rear. The chuck ring 35 is annularly formed with an approximately long rectangular-shaped transverse section in which a front opening thereof is larger than a rear opening thereof.

The tip fitting 23 is fixed to the front barrel 22. A base end part 23*a* of the tip fitting 23 is inserted and fitted into the front barrel 22 formed as a square tube. A trapezoidal guide piece 23*b* that tapers off toward the rear is formed in a protruded state at upper and lower positions of a rear end of the base end part 23*a*.

A (motion) breaker 24 formed of an elastic material is fitted from the vertical direction into a fixing hole 23*b*1 formed on the guide piece 23*b*. The breaker 24 clamps and holds upper and lower surfaces of the writing lead for a mechanical pencil L. The upper and lower surfaces of the writing lead for a mechanical pencil L which are formed from long sides of the rectangular sectional shape of the writing lead for a mechanical pencil L have a wider area than left and right surfaces which are formed from short sides of the sectional shape. By clamping the upper and lower surfaces which are opposing surfaces with a wider area than the other opposing surfaces of the writing lead for a mechanical pencil L, the breaker 24 can more firmly hold the writing lead for a mechanical pencil L. Even when gravity or an external force acts on the writing lead for a mechanical pencil L in a state where the writing lead for a mechanical pencil L is released from the chucking by the chuck 32, the writing lead for a mechanical pencil L being firmly held by the breaker 24 does not move (refer to FIG. 10).

Figure 8:
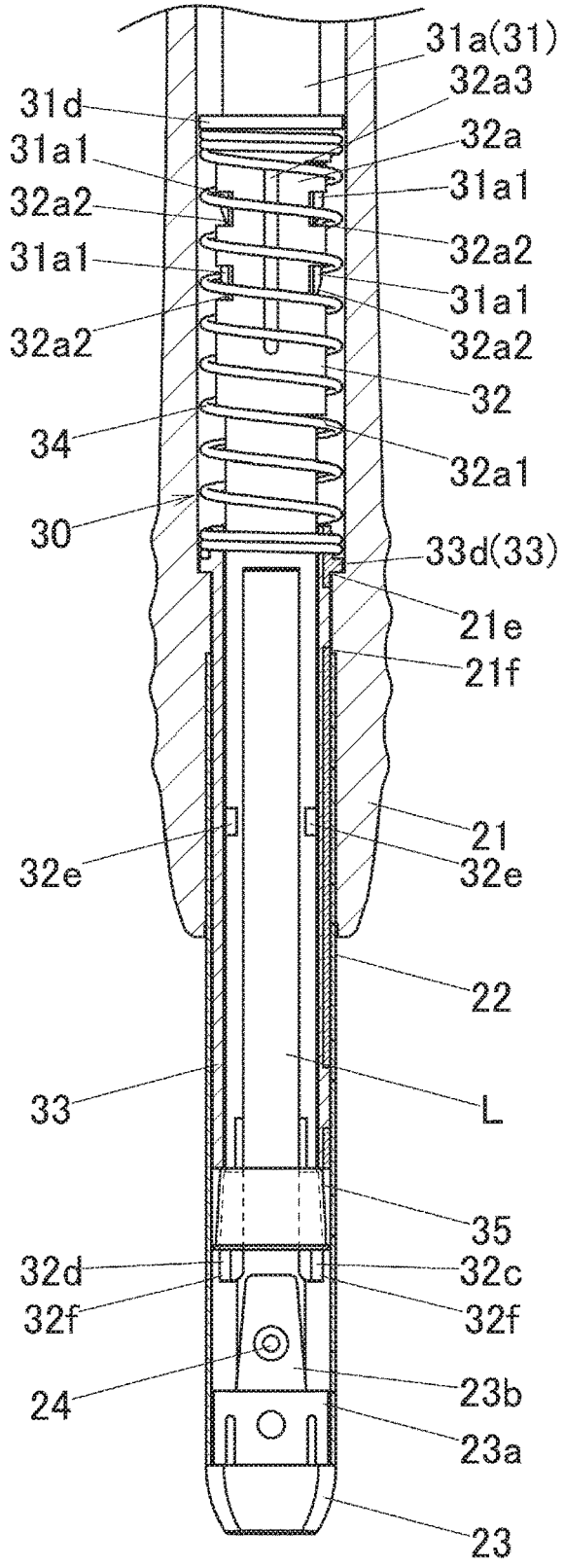
FIG. 8 is a diagram illustrating an actuated state of a mechanical pencil according to an embodiment of the present invention. The diagram illustrates a state where a writing lead for a mechanical pencil is sandwiched and chucked by a chuck.

Feed-out of the writing lead for a mechanical pencil L by the feed-out mechanism 30 will be described with reference to FIGS. 8 to 10. FIG. 8 illustrates a receded state where the assembly of the chuck 32 and the lead tank 31 has been biased rearward by the spring 34. In this state, a rear end surface of the bulging part 32*f* of the chuck 32 abuts against a front end surface of the chuck ring 35 and a rear end surface of the chuck ring 35 abuts against a front end surface of the inner shaft 33. The assembly of the chuck 32 and the lead tank 31 is restricted from moving further rearward. The chuck ring 35 is fitted to the chuck 32 by which the left and right chuck pieces 32*c* and 32*d* are pressed in the clamping direction of the chuck 32 and elastically deformed. In this state, the writing lead for a mechanical pencil L is chucked by the chuck 32.

Figure 9:
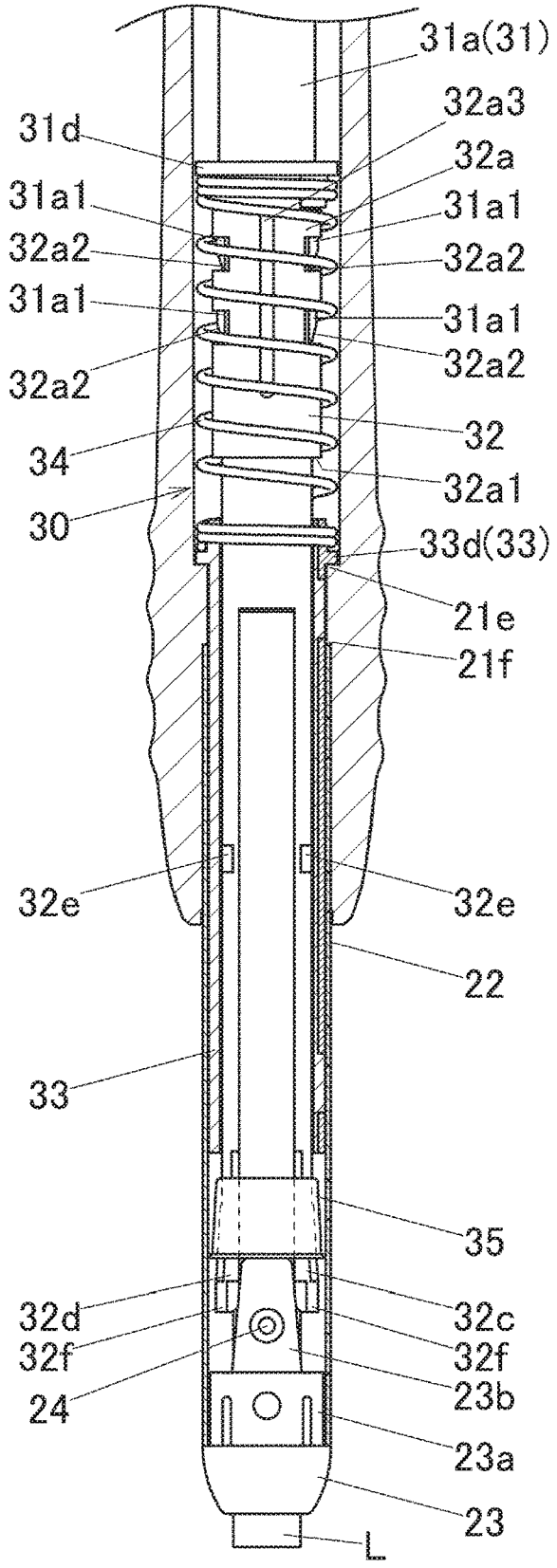
FIG. 9 is a diagram illustrating an actuated state of a mechanical pencil according to an embodiment of the present invention. The diagram illustrates a state where a feed-out mechanism has started releasing a writing lead for a mechanical pencil.

With reference to FIG. 9, the feed-out mechanism 30 in a state where a push operation of the push button 26 has been performed by the user and a tip surface of the chuck ring 35 abuts against a rear end surface of the guide piece 23*b* of the tip fitting 23 will be described. When the user performs a push operation of the push button 26 against a biasing force of the spring 34, the assembly of the chuck 32 fitted to the chuck ring 35 and chucking the writing lead for a mechanical pencil L and the lead tank 31 moves forward. The writing lead for a mechanical pencil L chucked by the chuck 32 moves forward and is fed out from a tip opening of the tip fitting 23. Once the front end surface of the chuck ring 35 abuts against the rear end surface of the guide piece 23*b*, further forward movement of the chuck ring 35 is restricted. When the chuck 32 moves further forward, the chuck ring 35 is detached from the chuck 32. The writing lead for a mechanical pencil L is released as the left and right chuck pieces 32*c* and 32*d* from which the chuck ring 35 has detached are resiliently restored by elasticity.

Furthermore, the mechanical pencil 10 according to the present embodiment includes the guide piece 23*b* having a guide surface which abuts against the chuck 32 and opens the chuck 32 in an opposite direction to the clamping direction of the chuck 32 (the horizontal direction) as the chuck 32 moves forward after the guide surface abuts against the chuck 32. When the chuck 32 moves further forward, the left and right chuck pieces 32*c* and 32*d* slide on the guide surface of the guide piece 23*b* and are forcibly opened. Therefore, the mechanical pencil 10 can more reliably release the writing lead for a mechanical pencil L.

Figure 10:
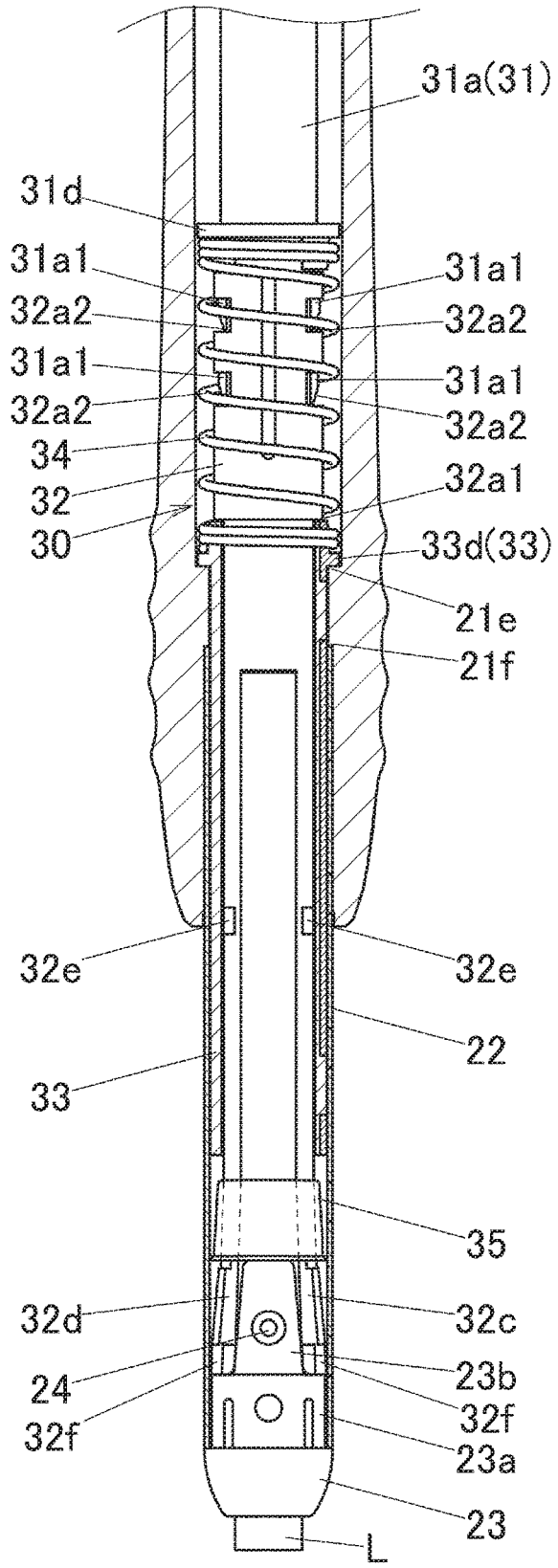
FIG. 10 is a diagram illustrating an actuated state of a mechanical pencil according to an embodiment of the present invention. The diagram illustrates a state where a feed-out mechanism has finished releasing a writing lead for a mechanical pencil.

With reference to FIG. 10, the feed-out mechanism 30 in a state where the chuck 32 has moved forward until the tip of the chuck 32 abuts against a rear end surface of the base end part 23*a* of the tip fitting 23 will be described. A front wall 32*a*1 of the connecting part 32*a* of the chuck 32 abuts against a rear end surface of the inner shaft 33. Due to the chuck 32 being restricted from moving further forward, the user can sense that feed-out of the writing lead for a mechanical pencil L has completed.

When the user releases the push operation of the push button 26, the assembly of the chuck 32 and the lead tank 31 recedes rearward due to the biasing force of the spring 34. The writing lead for a mechanical pencil L is held at the fed-out position in a state of being clamped by the (motion) breaker 24. The chuck ring 35 recedes rearward together with the open chuck 32, and the rear end surface of the chuck ring 35 abuts against the front end surface of the inner shaft 33. Further receding of the chuck ring 35 is restricted. The chuck 32 recedes further rearward until the rear end surface of the bulging part 32*f* of the chuck 32 abuts against the front end surface of the chuck ring 35. Once the chuck 32 recedes completely, the chuck ring 35 is fitted to the chuck 32 and a state prior to the push operation is restored (refer to FIG. 8).

Let us now return to FIG. 6 to describe chucking of the writing lead for a mechanical pencil L by the chuck 32 in detail. The writing lead for a mechanical pencil L is clamped and held by the first and second chuck pawls 41 and 42 of the chuck pawls 40 formed on the chuck 32. The first tip edge 41*b* formed at the tip of the first chuck pawl 41 is formed so as to form an angle of inclination $\alpha$ that acutely opens out ward as illustrated with respect to the clamping direction of the chuck 32. Therefore, the first tip edge 41*b* comes into point contact with a corner part of the writing lead for a mechanical pencil L (a ridge line formed in the longitudinal direction of the writing lead for a mechanical pencil L).

First contact stress is created at a point contact portion of the writing lead for a mechanical pencil L pressed by the first tip edge 41*b*. The point contact portion at which the first contact stress is created is a point on a ridge line of the writing lead for a mechanical pencil L where a load target region is restricted and compressive stress is applied in advance before some kind of impact is applied to the mechanical pencil 10 from the outside. When some kind of impact is transmitted from the outside in this state, the point contact portion of the writing lead for a mechanical pencil L reaches fracture stress and fractures temporally in advance of other portions of the writing lead for a mechanical pencil L. When the point contact portion of the writing lead for a mechanical pencil L fractures, a corresponding impact is absorbed. In addition, as will be described in detail later, after fracture of the point contact portion, the writing lead for a mechanical pencil L is chucked by the second chuck pawl 42 and does not come into contact with the first chuck pawl 41. Therefore, impact is prevented from being transmitted to the writing lead for a mechanical pencil L from the first chuck pawl 41 via the point contact portion. In this manner, a controlled fracture can be generated only in a point contact portion which least affects a decline in strength of the writing lead for a mechanical pencil L so as to temporally precede fractures that may occur at other portions of the writing lead for a mechanical pencil L. Therefore, impact transmitted to the writing lead for a mechanical pencil L from the outside can be absorbed and reduced. Even if the point contact portion subjected to the first contact stress fractures, significant damage such as a breakage is not inflicted to the writing lead for a mechanical pencil L. A visual observation of the writing lead for a mechanical pencil L of which the point contact portion is fractured reveals no problems in terms of external appearance and quality. Moreover, while four chuck pawls 40 are formed for each chuck piece in the present embodiment, in other embodiments, an arbitrary number of chuck pawls 40 may be formed so that favorable contact stress is obtained. In addition, the shape of the chuck pawls 40 may be modified as appropriate so that favorable contact stress is obtained.

A value of the first contact stress may be calculated by, for example, a numerical calculation using a finite element method. Alternatively, an analytically appropriate contact stress value may be obtained based on a Hertzian contact stress analysis or the like. For example, by adopting a configuration in which the value of the first contact stress is at a prescribed ratio to a value of fracture stress of a material constituting the writing lead for a mechanical pencil L, a controlled precursory fracture that is favorable for absorbing a prescribed impact transmitted to the writing lead for a mechanical pencil L from the outside can be generated. In the present embodiment, a configuration is adopted in which the value of the first contact stress (a calculated maximum value thereof) equals 30% of a value of compressive fracture stress of the material constituting the writing lead for a mechanical pencil L. Alternatively, in other embodiments, a configuration may be adopted in which an average value of the first contact stress at the point contact portion equals 30% of a value of tensile fracture stress of the material constituting the writing lead for a mechanical pencil L. In this manner, a configuration is favorably adopted in which the value of the first contact stress equals or exceeds approximately 30% of the value of fracture stress of the material constituting the writing lead for a mechanical pencil L. More favorably, a configuration may, be adopted in which the prescribed ratio of the value of the first contact stress to the value of fracture stress of the material constituting the writing lead for a mechanical pencil L equals or exceeds approximately 50% and, most favorably, a configuration may be adopted in which the prescribed ratio equals or exceeds approximately 70%. In this case, "approximately" refers to being within a value range of 10% with respect to the value of fracture stress of the material constituting the writing lead for a mechanical pencil L and, accordingly, the respective values described above premodified by "approximately" refer to "30±10%", "50±0%", and "70±10%".

The chuck pawl 40 includes the second chuck pawl 42. In the present embodiment, the second chuck pawl 42 is formed such that, in a state prior to fracture of the point contact portion of the writing lead for a mechanical pencil L with the first chuck pawl 41, the second chuck pawl 42 is positioned so as to be separated instead of coming into contact with the writing lead for a mechanical pencil L. According to this configuration, the point contact portion of the writing lead for a mechanical pencil L with the first chuck pawl 41 can be reliably made to reach fracture stress before a line contact portion of the writing lead for a mechanical pencil L with the second chuck pawl 42. Moreover, in other embodiments, a configuration may be adopted in which the second chuck pawl 42 comes into line contact (abuts against) the writing lead for a mechanical pencil L before the point contact portion of the writing lead for a mechanical pencil L with the first chuck pawl 41 fractures. The second tip edge 42*b* of the second chuck pawl 42 is configured to come into line contact when abutting against left and right surfaces of the writing lead for a mechanical pencil L. The second chuck pawl 42 applies, to the line contact portion of the writing lead for a mechanical pencil L, second contact stress that is lower than the first contact stress applied by the first chuck pawl 41 to the writing lead for a mechanical pencil L through point contact. According to this configuration, when the point contact portion subjected to the first contact stress of the writing lead for a mechanical pencil L fractures, the second chuck pawl 42 can be made to chuck the writing lead for a mechanical pencil L in place of the first chuck pawl 41. In doing so, the second chuck pawl 42 can hold the writing lead for a mechanical pencil L in a state where the first chuck pawl 41 and the writing lead for a mechanical pencil L are temporarily separated from each other. Therefore, further impact is prevented from being continuously transmitted to the writing lead for a mechanical pencil L from the first chuck pawl 41 via the fractured point contact portion of the writing lead for a mechanical pencil L.

In addition, a configuration may be adopted in which any impact not absorbed by a fracture of the point contact portion of the writing lead for a mechanical pencil L with the first chuck pawl 41 is absorbed by a fracture of the line contact portion of the writing lead for a mechanical pencil L with the second chuck pawl 42. In this case, the line contact portion of the writing lead for a mechanical pencil L with the second chuck pawl 42 is configured to fracture after a temporal delay from the fracture of the point contact portion of the writing lead for a mechanical pencil L with the first chuck pawl 41. When the line contact portion of the writing lead for a mechanical pencil L subjected to the second contact stress fractures, a corresponding impact is further absorbed. After the fracture of the line contact portion, the writing lead for a mechanical pencil L is once again chucked by the first chuck pawl 41 and is no longer in contact with the second chuck pawl 42. Therefore, further impact is prevented from being continuously transmitted to the writing lead for a mechanical pencil L from the second chuck pawl 42 via the line contact portion. In this manner, a configuration can be adopted in which a controlled fracture can be generated only in the line contact portion of the writing lead for a mechanical pencil L with the second chuck pawl 42 with a temporal difference from the fracture of the point contact portion of the writing lead for a mechanical pencil L with the first chuck pawl 41. Therefore, impact transmitted to the writing lead for a mechanical pencil L from the outside can be further absorbed and reduced. In the present embodiment, the line contact portion subjected to the second contact stress is configured so as to be positioned on left and right surfaces in the longitudinal direction with a large second moment of area in the rectangular sectional shape of the writing lead for a mechanical pencil L. Therefore, the fracture of the line contact portion of the writing lead for a mechanical pencil L with the second chuck pawl 42 does not significantly impact a decline in bending strength of the writing lead for a mechanical pencil L. Even if the line contact portion subjected to the second contact stress fractures, significant damage such as a breakage is not inflicted to the writing lead for a mechanical pencil L. A visual observation of the writing lead for a mechanical pencil L of which the line contact portion has been fractured reveals no problems in terms of external appearance and quality.

A value of the second contact stress may be calculated by, for example, a numerical calculation using a finite element method. Alternatively, an analytically appropriate contact stress value may be obtained based on a Hertzian contact stress analysis or the like. For example, a configuration is adopted in which the value of the second contact stress is in a prescribed ratio to the value of the first contact stress. According to this configuration, a controlled fracture of the line contact portion that is favorable for absorbing other prescribed impact transmitted to the writing lead for a mechanical pencil L from the outside can be generated with a sufficient temporal difference after the fracture of the point contact portion of the writing lead for a mechanical pencil L subjected to the first contact stress. In the present embodiment, a configuration is adopted in which the value of the second contact stress (a calculated maximum value thereof) equals 80% of a value of the first contact stress (a calculated maximum value thereof). Alternatively, in other embodiments, a configuration may be adopted in which an average value of the second contact stress at the line contact portion equals 80% of the average value of the first contact stress at the point contact portion. In this manner, a configuration is favorably adopted in which the value of the second contact stress is equal to or smaller than approximately 80% of the value of the first contact stress. More favorably, a configuration may be adopted in which the prescribed ratio of the value of the second contact stress to the value of the first contact stress is equal to or smaller than approximately 60% and, most favorably, a configuration may be adopted in which the prescribed ratio is equal to or smaller than approximately 40%, In this case, "approximately" refers to being within a value range of 10% with respect to the value of the first contact stress and, accordingly, the respective values described above premodified by "approximately" refer to "80±10%", "60±10%", and "40±10%".

When the line contact portion of the writing lead for a mechanical pencil L with the second chuck pawl 42 is further fractured, the first chuck pawl 41 once again comes into contact with an unfractured outer surface of the writing lead for a mechanical pencil L. Even in this case, a configuration is favorably adopted in which the first chuck pawl 41 comes into line contact with the writing lead for a mechanical pencil L. A configuration is favorably adopted in which at least the value of the first contact stress applied by the first chuck pawl 41 to the writing lead for a mechanical pencil L is larger than the value of the second contact stress applied by the second chuck pawl 42 to the writing lead for a mechanical pencil L. According to this configuration, impact from the outside can be repetitively absorbed by having the first chuck pawl 41 and the second chuck pawl 42 alternately chuck the writing lead for a mechanical pencil L with larger contact stress than the other. In addition, a configuration is favorably adopted in which a contact portion of the writing lead for a mechanical pencil L with the first chuck pawl 41 and contact portion of the writing lead for a mechanical pencil L with the second chuck pawl 42 are arranged so as to be dispersed in portions with less influence to a decline in strength of the writing lead for a mechanical pencil L. According to this configuration, portions at which the writing lead for a mechanical pencil L may potentially sustain damage from impact from the outside can be dispersed and made less conspicuous in an exterior appearance and, at the same time, a decline in strength of the writing lead for a mechanical pencil L can be prevented.

Since the writing lead for a mechanical pencil L according to the present embodiment described above is constantly chucked by one of or both of the first chuck pawl 41 and the second chuck pawl 42, feed-out of the writing lead for a mechanical pencil L is performed without incident. In addition, due to a fracture of a contact portion of the writing lead for a mechanical pencil L, the first and second chuck pawls 41 and 42 are to chuck the writing lead for a mechanical pencil L by penetrating deeper into the writing lead for a mechanical pencil L than before. Therefore, a secondary effect is produced in that, when the user uses the mechanical pencil 10, a failure known as lead slippage in which the writing lead for a mechanical pencil L recedes due to writing pressure can be prevented.

While an embodiment of the present invention has been described above, it is to be understood that the present invention is not limited to the present embodiment and may be implemented with a wide variety of modifications. For example, the present embodiment has been described to include the left chuck piece 32*c* and the right chuck piece 32*d* as chuck pieces for chucking the writing lead for a mechanical pencil L with a rectangular section on ridge lines and on left and right side surfaces thereof. However, the chuck pieces may be provided in an arbitrary number and the chuck pieces may be configured to grip other arbitrary side surfaces of the writing lead for a mechanical pencil L. In addition, as the sectional shape of the writing lead for a mechanical pencil L, an arbitrary shape such as a circle or other polygonal shapes may be adopted. Furthermore, in addition to the materials exemplified in the present embodiment, the components of the mechanical pencil 10 may be formed of arbitrary materials.

In addition, in the present embodiment, it has been described that the first chuck pawl 41 comes into point contact with the writing lead for a mechanical pencil L and the second chuck pawl 42 comes into line contact with the writing lead for a mechanical pencil L. However, as long as the second chuck pawl comes into contact with the writing lead for a mechanical pencil so as to apply, to the writing lead for a mechanical pencil, the second contact stress that is lower than the first contact stress applied to the writing lead for a mechanical pencil by the first chuck pawl, the first chuck pawl may come into line contact with the writing lead for a mechanical pencil. In addition, the second chuck pawl may come into contact with the writing lead for a mechanical pencil in an arbitrary contact mode including point contact, surface contact, and a combination thereof. Furthermore, point contact and line contact as described above are concepts including substantial point contact and line contact by unintentional machine-processed round parts that should be permissible in manufacturing of components of a writing instrument and a writing lead for a writing instrument.

In addition, in the present embodiment, while the mechanical pencil 10 that feeds out the writing lead for a mechanical pencil L formed of graphite has been described as an example, the writing lead for a writing instrument (implement) according to the present invention is not limited to those formed of graphite and includes writing leads (materials) for a writing instrument formed of an arbitrary material and having an arbitrary color. Furthermore, the writing instrument according to the present invention includes a writing lead holder and the like provided with a chuck that does not have a feed-out mechanism. The usage of the writing instrument is not limited to writing, and the writing instrument may be used as a cosmetic such as an eye liner.

What is claimed is:

1. A writing instrument adapted to be used with a writing lead, the writing instrument including:

a chuck configured to sandwich and to chuck the writing lead for the writing instrument, wherein the chuck includes:

a first chuck pawl which comes into point contact or line contact with the writing lead for the writing instrument to press the writing lead for the writing instrument so as to apply first contact stress to the writing lead for the writing instrument; and a second chuck pawl which presses the writing lead for the writing instrument so as to apply, to the writing lead for the writing instrument, second contact stress that is lower than the first contact stress, and the first contact stress applied by the first chuck pawl to the writing lead for the writing instrument is configured such that, when a prescribed impact is applied to the writing lead for the writing instrument, a contact portion of the writing lead for the writing instrument subjected to the first contact stress fractures and absorbs the prescribed impact.

2. The writing instrument according to claim 1, wherein the second chuck pawl is configured to come into point contact or line contact with the writing lead for the writing instrument and to apply the second contact stress to the writing lead for the writing instrument, and the second contact stress is configured such that, when a larger impact than the prescribed impact is applied to the writing lead for the writing instrument, another contact portion of the writing lead for the writing instrument is subjected to the second contact stress fractures and absorbs the larger impact.

3. The writing instrument according to claim 2, further comprising a writing lead, wherein the writing lead for the writing instrument has a polygonal sectional shape having ridge lines in a longitudinal direction thereof, and the first chuck pawl comes into point contact or line contact with one of the ridge lines of the writing lead for the writing instrument so as to apply the first contact stress to the one of the ridge lines.

4. The writing instrument according to claim 3, wherein the chuck is configured to feed out the writing lead for the writing instrument by moving forward, and the writing instrument further comprises a guide piece that abuts against the chuck when the chuck moves forward, the guide piece having a guide surface that, when the chuck moves further forward after the guide piece abuts against the chuck, opens the chuck in a direction opposite to a direction in which the chuck sandwiches the writing lead for the writing instrument.

5. The writing instrument according to claim 3, wherein the writing lead for the writing instrument has a rectangular sectional shape, the chuck includes a pair of the first chuck pawls which oppose each other in a direction along an axis in a longitudinal direction of the rectangle, and a pair of the second chuck pawls which oppose each other in the opposing direction, the pair of the first chuck pawls and the pair of the second chuck pawls respectively sandwiching and chucking the writing lead for the writing instrument in the opposing direction, the pair of the opposing first chuck pawls have ridge lines that are inclined relative to the axis in the longitudinal direction of the rectangle and that sandwich and chuck the ridge lines of the writing lead for the writing instrument in the opposing direction, and the pair of the opposing second chuck pawls sandwich and chuck, in the opposing direction, surfaces formed from short sides of the rectangular sectional shape of the writing lead for a writing instrument.

6. The writing instrument according to claim 5, wherein the chuck is configured to feed out the writing lead for the writing instrument by moving forward, and the writing instrument further comprises a guide piece that abuts against the chuck when the chuck moves forward, the guide piece having a guide surface that, when the chuck moves further forward after the guide piece abuts against the chuck, opens the chuck in a direction opposite to a direction in which the chuck sandwiches the writing lead for the writing instrument.

7. The writing instrument according to claim 2, further comprising a writing lead, wherein the chuck is configured to feed out the writing lead for the writing instrument by moving forward, and the writing instrument further comprises a guide piece that abuts against the chuck when the chuck moves forward, the guide piece having a guide surface that, when the chuck moves further forward after the guide piece abuts against the chuck, opens the chuck in a direction opposite to a direction in which the chuck sandwiches the writing lead for the writing instrument.

8. The writing instrument according to claim 1, further comprising a writing lead, wherein the writing lead for the writing instrument has a polygonal sectional shape having ridge lines in a longitudinal direction thereof, and the first chuck pawl comes into point contact or line contact with one of the ridge lines of the writing lead for the writing instrument so as to apply the first contact stress to the one of the ridge lines.

9. The writing instrument according to claim 8, wherein the chuck is configured to feed out the writing lead for the writing instrument by moving forward, and the writing instrument further comprises a guide piece that abuts against the chuck when the chuck moves forward, the guide piece having a guide surface that, when the chuck moves further forward after the guide piece abuts against the chuck, opens the chuck in a direction opposite to a direction in which the chuck sandwiches the writing lead for the writing instrument.

10. The writing instrument according to claim 8, wherein the writing lead for the writing instrument has a rectangular sectional shape, the chuck includes a pair of the first chuck pawls which oppose each other in a direction along an axis in a longitudinal direction of the rectangle, and a pair of the second chuck pawls which oppose each other in the opposing direction, the pair of the first chuck pawls and the pair of the second chuck pawls respectively sandwiching and chucking the writing lead for the writing instrument in the opposing direction, the pair of the opposing first chuck pawls have ridge lines that are inclined relative to the axis in the longitudinal direction of the rectangle and that sandwich and chuck the ridge lines of the writing lead for the writing instrument in the opposing direction, and the pair of the opposing second chuck pawls sandwich and chuck, in the opposing direction, surfaces formed from short sides of the rectangular sectional shape of the writing lead for the writing instrument.

11. The writing instrument according to claim 10, wherein the chuck is configured to feed out the writing lead for the writing instrument by moving forward, and the writing instrument further comprises a guide piece that abuts against the chuck when the chuck moves forward, the guide piece having a guide surface that, when the chuck moves further forward after the guide piece abuts against the chuck, opens the chuck in a direction opposite to a direction in which the chuck sandwiches the writing lead for the writing instrument.

12. The writing instrument according to claim 1, further comp rising writing lead, wherein a sectional shape of the writing lead for the writing instrument has a longitudinal direction and a transverse direction, and the longitudinal direction of the sectional shape of the writing lead for the writing instrument is consistent with a longitudinal direction of a sectional shape of a grip part of the writing instrument.

13. The writing instrument according to claim 12, wherein the chuck is configured to feed out the writing lead for the writing instrument by moving forward, and the writing instrument further comprises a guide piece that abuts against the chuck when the chuck moves forward, the guide piece having a guide surface that, when the chuck moves further forward after the guide piece abuts against the chuck, opens the chuck in a direction opposite to a direction in which the chuck sandwiches the writing lead for the writing instrument.

14. The writing instrument according to claim 1, further comprising a writing lead, wherein the chuck is configured to feed out the writing lead for the writing instrument by moving forward, and the writing instrument further comprises a guide piece that abuts against the chuck when the chuck moves forward, the guide piece having a guide surface that, when the chuck moves further forward after the guide piece abuts against the chuck, opens the chuck in a direction opposite to a direction in which the chuck sandwiches the writing lead for the writing instrument.

* * * * *